United States Patent [19]

Reindel

[11] Patent Number: 5,004,993

[45] Date of Patent: Apr. 2, 1991

[54] CONSTRICTED SPLIT BLOCK WAVEGUIDE LOW PASS FILTER WITH PRINTED CIRCUIT FILTER SUBSTRATE

[75] Inventor: John Reindel, San Diego, Calif.

[73] Assignee: The United States of America as represented by the Secretary of the Navy, Washington, D.C.

[21] Appl. No.: 410,385

[22] Filed: Sep. 19, 1989

[51] Int. Cl.[5] ..... H01P 1/207

[52] U.S. Cl. ..... 333/208; 333/21 R; 333/248

[58] Field of Search ..... 333/208–212, 333/239, 248, 34, 35, 21 R

[56] References Cited

U.S. PATENT DOCUMENTS

| | | | |
|---|---|---|---|
| 3,916,352 | 10/1975 | Powell | 333/208 |
| 3,949,327 | 4/1976 | Chapell | 333/251 X |
| 3,952,270 | 4/1976 | Louvel | 333/208 |
| 4,028,650 | 6/1977 | Konishi et al. | 333/208 |
| 4,052,683 | 10/1977 | van Heuven et al. | 333/239 X |
| 4,096,457 | 6/1978 | Snyder | 333/208 |
| 4,157,516 | 6/1979 | van de Grijp | 333/35 X |
| 4,673,903 | 6/1987 | Saad | 333/210 |
| 4,897,623 | 1/1990 | Reindel | 333/208 |

FOREIGN PATENT DOCUMENTS

| | | | |
|---|---|---|---|
| 0033512 | 3/1978 | Japan | 455/328 |
| 0199302 | 9/1986 | Japan | 333/208 |

OTHER PUBLICATIONS

Matthaei et al., "Microwave Filters, Impedance-Matching Networks, and Coupling Structures", 1964, pp. 390–399, McG-H.

Levy, "Tapered Corrugated Waveguide Low-Pass Filters", Aug., 1973, pp. 526–532, IEEE Transactions on Microwave Theory & Techniques, vol. MTT-21, No. 8.

*Primary Examiner*—Eugene R. LaRoche
*Assistant Examiner*—Seung Ham
*Attorney, Agent, or Firm*—Harvey Fendelman; Thomas Glenn Keough

[57] ABSTRACT

A waveguide low pass filter is composed of an assembly of an outer waveguide, an inner waveguide shorter in length than the outer waveguide, and a printed circuit filter substrate. The outer and inner waveguides have split block constructions. The inner waveguide is mounted within the outer waveguide so as to form a constriction within the outer waveguide limiting propagation of energy within the outer waveguide to the fundamental $TE_{10}$ waveguide mode. The printed circuit filter substrate is mounted to extend longitudinally between the assembled split halves of the respective outer and inner waveguides, and is constructed of a substantially planar dielectric substrate element and upper and lower conductive plate elements on the substrate and lying in the plane thereof. The conductive plate elements define a tapered dual ridge transformer section. The lower plate element has longitudinally spaced vertical slots formed therein defining an open stub slotted filter array.

16 Claims, 1 Drawing Sheet

CONSTRICTED SPLIT BLOCK WAVEGUIDE LOW PASS FILTER WITH PRINTED CIRCUIT FILTER SUBSTRATE

STATEMENT OF GOVERNMENT INTEREST

The invention described herein may be manufactured and used by or for the Government of the United States of America for governmental purposes without the payment of any royalties thereon or therefor.

BACKGROUND OF THE INVENTION

The present invention generally relates to the field of waveguide filters and, more particularly, to a constricted split block waveguide low pass filter having a printed circuit filter substrate.

One conventional waveguide low pass filter, called a waffle-iron filter, uses longitudinal slots and transverse grooves to define a plurality of metal islands or bosses in the broad waveguide walls to suppress higher order modes. The transverse grooves attenuate the fundamental $TE_{10}$ mode; the longitudinal slots suppress the higher order $TE_{n0}$ modes. Typically, a waffle-iron filter is designed to suppress up to three times the low-pass filter frequency.

The slots and grooves of the waffle-iron filter are generally cut by machining a metal insert and then bonding the machined insert within the waveguide. A drawback of this conventional waffle-iron filter is that its construction requires high precision machining and thus its cost of manufacture is high.

Consequently, a need exists for a waveguide low pass filter having a low cost design which avoids the necessity for precise and costly manufacturing steps in its construction.

SUMMARY OF THE INVENTION

The present invention relates to a constricted split block waveguide low pass filter which permits the use of low cost construction techniques while, at the same time, providing very broad rejection bands. The low pass filter of the present invention uses a simple method of construction which eliminates machining by assembling a smaller inner split block waveguide within a larger outer split block waveguide and mounting a printed circuit filter substrate longitudinally therebetween. The printed circuit filter substrate enhances design accuracy by employment of conventional lithographics and chemical etching techniques.

OBJECTS OF THE INVENTION

Accordingly, it is the primary object of the present invention to disclose a waveguide low pass filter with very broad rejection bands.

Another object of the present invention is to disclose a waveguide low pass filter employing low cost and simple construction and assembly techniques.

Still another object of the present invention is to disclose a waveguide low pass filter employing an assembly of a split block inner waveguide within a split block outer waveguide for providing a constriction therein.

A further object of the present invention is to disclose a waveguide low pass filter using a printed circuit filter substrate having an elongated substrate with arrays of low pass filter elements thereon installed in the constricted split block waveguide assembly.

Other objects, advantages and novel features of the invention will become apparent from the following detailed description of the invention when considered in conjunction with the accompanying drawings.

DETAILED DESCRIPTION OF THE INVENTION

Figure 1:
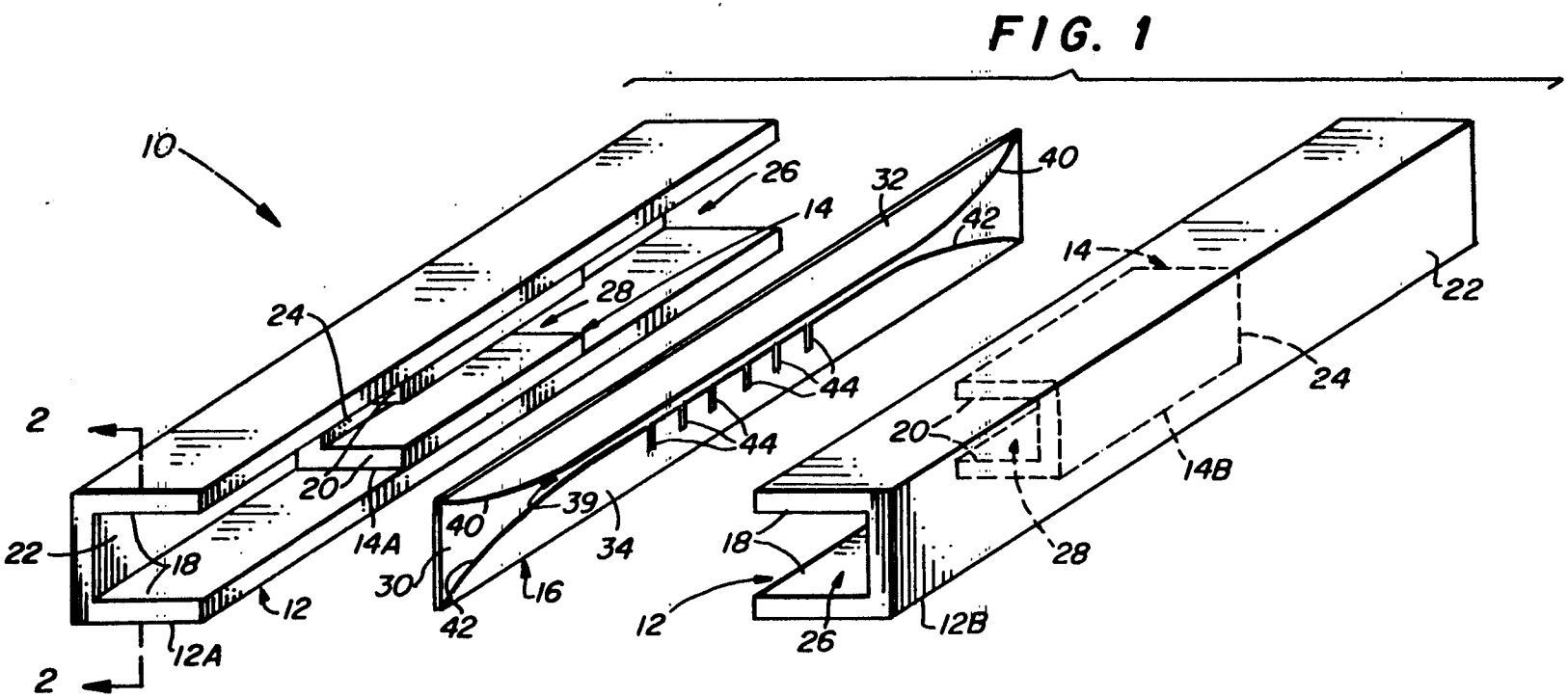
FIG. 1 is an exploded perspective view of a waveguide low pass filter in accordance with the present invention.

Referring now to the drawings, and particularly to FIG. 1, there is shown in exploded form a waveguide low pass filter, generally designated 10, having a low cost, simple construction in accordance with the present invention. The filter 10 has an extended frequency range of the fundamental mode and transitions into and out of the filter provided by an assembly of outer waveguide 12, an inner waveguide 14, and a printed circuit filter substrate 16.

Outer and inner waveguides 12 and 14 of low pass filter 10 both have split block constructions and hollow rectangular shapes. Outer and inner waveguides 12 and 14 are made of a suitable electrically conductive metal and are composed of split halves 12A, 12B and 14A, 14B, respectively. Corresponding ones of split waveguide halves 12A, 14A and 12B, 14B are assembled by being bonded together or are of a one-piece construction wherein the inner waveguide half is machined from the outer waveguide half. In the case where they are separate parts, they are sized relative to one another to permit split halves 14A and 14B of inner waveguide 14 to fit tightly within corresponding split halves 12A and 12B of outer waveguide 12 before bonding together. Inner waveguide halves 14A and 14B are substantially shorter in length than outer waveguide halves 12A and 12B. Although split block constructions provided by part bonding or one-piece machining have been described, any other suitable manufacturing or assembly/attaching techniques could be used within the scope of the present invention.

Figure 2:
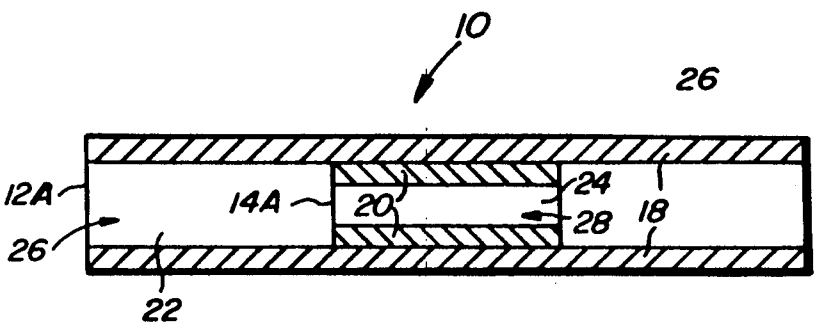
FIG. 2 is a longitudinal sectional view of the filter taken along line 2—2 of FIG. 1.
Figure 3:
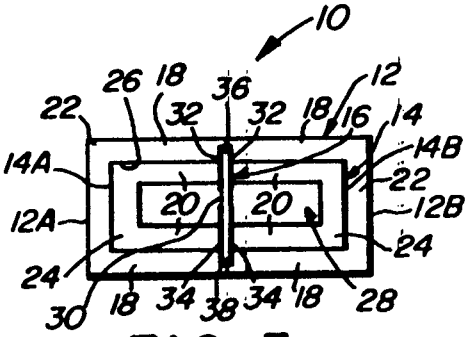
FIG. 3 is an end view of the filter of FIG. 1 after assembly.

Referring also to FIGS. 2 and 3, when respective waveguide halves 12A and 12B and 14A and 14B are assembled together, they form respective pairs of opposing broad walls 18 and 20 and narrow walls 22 and 24 of outer and inner waveguides 12 and 14. Narrow walls 22 and 24 extend orthogonally between and interconnect respective broad walls 18 and 20 to define hollow cavities 26 and 28 through outer and inner waveguides 12 and 14. The inner waveguide 14 thus mounted within outer waveguide 12 forms a constriction within outer cavity 26 to the propagation of electromagnetic energy within outer waveguide 12 in the fundamental $TE_{10}$ waveguide mode in the longitudinal direction of hollow cavities 26 and 28.

Referring to FIGS. 1 and 3, printed circuit filter substrate 16 of low pass filter 10 is mounted to extend longitudinally between assembled split halves 12A and 12B and 14A and 14B of respective outer and inner waveguides 12 and 14. Printed circuit filter substrate 16 is constructed of a substantially planar dielectric substrate element 30 and an upper and lower conductive elements 32 and 34 plated on one or both sides or surfaces of substrate 30 so as to lie in the common plane of substrate 30. Printed circuit filter substrate 16, composed of dielectric substrate element 30 with conductive plate elements 32 and 34 thereon, is mounted through outer and inner waveguide interior cavities 26 and 28 in a centered relation between narrow walls 22 and 24 of outer and inner waveguides 12 and 14 by the upper and lower edges of the substrate element being fitted within grooves or recesses 36 and 38 formed by assembled outer waveguide halves 12A and 12B, as seen in FIG. 3, with the upper and lower conductive plate elements 32 and 34 in electrical contact with broad walls 18 and 20 of respective outer and inner waveguides 12 and 14. Printed circuit filter substrate 16 thus extends between broad walls 18 and 20 of respective outer and inner waveguides 12 and 14 with the plane of dielectric substrate element 30 and conductive plate elements 32 and 34 thereon oriented substantially parallel to narrow walls 22 and 24 and orthogonal to broad walls 18 and 20 of respective outer and inner waveguides 12 and 14.

The opposite end openings of the outer waveguide 12 matches that used conventionally, whereas the width and height of the inside constriction defined by inner waveguide 14 is selected to be less than that for which the $TE_{20}$ mode can propagate at the highest desirable rejection band frequency. The conductive plate elements 32 and 34 of printed circuit filter substrate 16 are spaced apart vertically to provide a gap 39 therebetween and to preferably define upper and lower tapered dual ridge transformers 40 and 42. The lower plate element 34 also has a series of longitudinally-spaced vertical slots 44 formed therein which define an open stub slotted filter array in the lower plate element. Tapered transformers 40 and 42 match the waveguide $TE_{10}$ mode at the input and output of outer waveguide 12 to that of a narrow slot ridge waveguide mode in the constriction of the filter 10 provided by inner waveguide 14. Alternatively, only one of conductive plate elements 32 and 34 could be used to define a single ridge transformer. Also, slots 44 can have linear configurations or other configurations, such as L-shaped, designed to reflect signals at various frequencies in the rejection band.

The waveguide low pass filter 10 of the invention is suitable for millimeter wave filters because the critical dimensions are achieved by lithography and chemical etching. The filter is applicable to new EW system requirements for band selection, multiplexing and harmonic rejection.

It is thought that the present invention and many of its attendant advantages will be understood from the foregoing description and it will be apparent that various changes may be made in the form, construction and arrangement of the parts thereof without departing from the spirit and scope of the invention or sacrificing all of its material advantages, the forms hereinbefore described being merely exemplary embodiments thereof.

Having thus described the invention, what is claimed is:

1. A waveguide low pass filter, comprising:

(a) an outer waveguide;

(b) an inner waveguide shorter in length than, and disposed within, said outer waveguide so as to form a constriction within said outer waveguide limiting the propagation of energy to the fundamental $TE_{10}$ mode; and (c) a slotted ridge filter array mounted longitudinally through said outer and inner waveguides.

2. The filter of claim 1 wherein said outer and inner waveguides have split block constructions.

3. The filter of claim 2 wherein said slotted ridge filter array extends longitudinally between opposite halves of the assembled split block outer and inner waveguides.

4. The filter of claim 1 wherein said slotted ridge filter array includes a substantially planar dielectric substrate element, and upper and lower conductive plate elements each having a planar mounting surface mounted to said dielectric substrate element.

5. The filter of claim 4 wherein said plate elements define a tapered dual ridge transformer section.

6. The filter of claim 4 wherein said lower plate element has longitudinally spaced substantially vertical slots formed therein defining an open stub slotted filter array.

7. A waveguide low pass filter, comprising:

(a) an outer waveguide;

(b) an inner waveguide shorter in length than, disposed within, and spaced from opposite ends of, said outer waveguide so as to form an energy propagation constriction within said outer waveguide; and (c) a substantially planar printed circuit filter substrate defining a slotted ridge filter array being mounted longitudinally through said outer and inner waveguides.

8. The filter of claim 7 wherein said outer and inner waveguides have split block constructions.

9. The filter of claim 8 wherein said substrate is mounted to extend longitudinally between opposite halves of the assembled split block outer and inner waveguides.

10. The filter of claim 9 wherein said outer waveguide has oppositely-facing longitudinally-extending recesses defined in opposite broad walls of said outer waveguide which mount said substrate at opposite longitudinal edges thereof.

11. The filter of claim 7 wherein said substrate is constructed of a substantially planar dielectric substrate element and upper and lower spaced conductive plate elements on said substrate which lie in the plane thereof.

12. The filter of claim 11 wherein said plate elements define a tapered dual ridge transformer section.

13. The filter of claim 11 wherein said lower plate element has longitudinally spaced vertical slots formed therein defining an open stub slotted filter array.

14. A waveguide low pass filter, comprising:

an outer waveguide having an interior with a rectangular cross-sectional area;

an inner waveguide having an interior with a rectangular cross-sectional area and an exterior surface, said inner waveguide mounted within said interior of said outer waveguide such that said exterior surface of said inner waveguide conformably fits in contacting engagement within said interior of said outer waveguide, said inner waveguide being shorter in length than said outer waveguide; and a filter comprising a flat member mounted within the interiors of said inner and outer waveguides so as to define two channels having rectangular cross-sectional areas within said inner waveguide, said flat member including a tapered dual ridge guide structure defining a channel for conducting electromagnetic radiation, said guide structure being electrically connected to said inner and outer waveguides.

15. The waveguide of claim 14 wherein said tapered dual ridge guide structure includes;

a first conductive plate mounted flat to said flat member and having vertical slots contiguous to said channel formed in said first conductive plate; and a second conductive plate mounted flat to said flat member.

16. The waveguide of claim 15 wherein:

said vertical slots are formed in said first conductive plate by photolithographic processes.

* * * * *